US009263200B2

(12) United States Patent
Zehnder et al.

(10) Patent No.: US 9,263,200 B2
(45) Date of Patent: Feb. 16, 2016

(54) HIGH-CURRENT SWITCHING ARRANGEMENT

(71) Applicant: ABB Technology AG, Zürich (CH)

(72) Inventors: Lukas Zehnder, Baden-Dättwil (CH); Andreas Nohl, Uhwiesen (CH); Hans Wyder, Forch (CH); Erwin Manz, Lauchringen (DE); Jean-Claude Mauroux, Hunzenschwil (CH); Werner Sigrist, Winkel (CH); Guenter Steding, Lottstetten (DE); Alexander Schmidt, Zürich (CH)

(73) Assignee: ABB TECHNOLOGY AG, Zurich (CH)

( * ) Notice: Subject to any disclaimer, the term of this patent is extended or adjusted under 35 U.S.C. 154(b) by 329 days.

(21) Appl. No.: 13/715,200

(22) Filed: Dec. 14, 2012

(65) Prior Publication Data

US 2013/0153385 A1 Jun. 20, 2013

(30) Foreign Application Priority Data

Dec. 14, 2011 (EP) ..... 11193493

(51) Int. Cl.
*H01H 31/00* (2006.01)
*H01H 3/02* (2006.01)
*H01H 3/46* (2006.01)
(Continued)

(52) U.S. Cl.
CPC . *H01H 3/02* (2013.01); *H01H 3/46* (2013.01); *H01H 33/008* (2013.01); *H01H 33/42* (2013.01)

(58) Field of Classification Search
USPC ..... 200/48 R, 48 A
See application file for complete search history.

(56) References Cited

U.S. PATENT DOCUMENTS 4,188,515 A * 2/1980 Patel et al. ..... 200/48 R
4,188,516 A * 2/1980 Patel et al. ..... 200/48 R
(Continued)

FOREIGN PATENT DOCUMENTS

DE 92 02 810 U1 4/1992
DE 197 01 827 A1 7/1998
(Continued)

OTHER PUBLICATIONS

Search Report issued on May 23, 2012, by the European Patent Office for Application No. 11193493.1.
(Continued)

*Primary Examiner* — Renee Luebke
*Assistant Examiner* — Lheiren Mae A Caroc
(74) *Attorney, Agent, or Firm* — Buchanan Ingersoll & Rooney PC

(57) ABSTRACT

An exemplary high-current switching arrangement in a generator duct arranged between a generator and a transformer is disclosed. This arrangement includes a pole frame which can be positioned on a base surface, a breaker pole of a generator circuit-breaker which is secured to the pole frame, and a drive which is secured to the pole frame. The breaker pole includes an active component arranged along an axis designed for the conduction and interruption of high currents and which incorporates a power switching point, with two axially spaced current terminals. The drive is arranged on a first of two end faces of the pole frame, and includes a linkage mechanism that transmits power from the drive to the power switching point.

11 Claims, 1 Drawing Sheet

(51) Int. Cl.
*H01H 33/00* (2006.01)
*H01H 33/42* (2006.01)

(56) References Cited

U.S. PATENT DOCUMENTS

| | | | | |
|---|---|---|---|---|
| 4,288,667 | A * | 9/1981 | Patel et al. | 200/48 R |
| 5,012,051 | A | 4/1991 | Tsukushi et al. | |
| 5,985,628 | A | 11/1999 | Adel et al. | |
| 2004/0216990 | A1 | 11/2004 | Hunger et al. | |

FOREIGN PATENT DOCUMENTS

| | | | |
|---|---|---|---|
| EP | 0 369 280 | A1 | 5/1990 |
| EP | 1 641 011 | A1 | 3/2006 |
| EP | 1 284 491 | B1 | 12/2006 |

OTHER PUBLICATIONS

"Generator Circuit-Breaker Systems HECS, HEC 7/8", published by the firm ABB Schweiz AG, date unknown, pp. 1-15.

* cited by examiner

HIGH-CURRENT SWITCHING ARRANGEMENT

RELATED APPLICATION

This application claims priority under 35 U.S.C. §119 to European Patent Application No. 11193493.1 filed in Europe on Dec. 14, 2011, the entire content of which is hereby incorporated by reference in its entirety.

FIELD

The present disclosure relates to switching arrangements, such as a high-current switching arrangement for incorporation in a generator duct.

BACKGROUND INFORMATION

In a high-voltage energy supply system, a high-current switching arrangement is incorporated into an electrical connection between a generator and a transformer. This switching arrangement is capable of conducting high continuous currents and of interrupting high short-circuit currents. Accordingly, this arrangement is provided with a circuit interrupter, described as a generator circuit-breaker, with a power switching point in which, during a switching process, a contact member of high mass is accelerated at a substantial rate. The energy specified for this purpose is generated by a high-power drive which occupies a substantial amount of space.

A high-current switching arrangement of the above-mentioned type is described in the commercial document "Generator Circuit-Breaker Systems HECS, HEC7/8" published by the firm ABB Schweiz AG, Zurich, Switzerland. In this high-current switching arrangement, the three phase-segregated breaker poles of a generator circuit-breaker are arranged on a pole frame. Each of these breaker poles is provided with an enclosure, configured as a box-type enclosure, which accommodates at least a power switching point, but also additional switching components such as disconnectors, ground electrodes and starting switches, and may also accommodate further components such as instrument transformers or surge arresters. The enclosure is provided with two openings, arranged in two side walls opposite each other and through which, after incorporation in a shock-hazard-protected three-phase generator duct, one of the three phase conductors respectively of the generator duct is routed. Next to the pole frame, a drive is arranged transversely to the direction of routing of the phase conductors, which acts on the three power switching points via a linkage mechanism.

EP 1284491 B1 describes a three-phase generator circuit-breaker, the three power switching points of which are arranged directly on a single pole frame, e.g., with no shock-hazard protection. A drive is secured to the pole frame below the power switching points, which acts on all three switching points via a linkage mechanism.

SUMMARY

An exemplary high-current switching arrangement for incorporation in a generator duct arranged between a generator and a transformer is disclosed, the arrangement comprising: a pole frame which can be positioned on a base surface; a breaker pole of a generator circuit-breaker which is secured to the pole frame; and a drive which is secured to the pole frame, wherein the breaker pole is provided with an active component arranged along an axis designed for conduction and interruption of high currents and which incorporates a power switching point, the breaker pole having two axially spaced current terminals for an electrically-conductive integration of the active component upon incorporation of the high-current switching arrangement in a circuit path of a high-voltage conductor in the generator duct, and wherein the drive is arranged on a first of two end faces of the pole frame and is oriented transversely to the axis, and a linkage mechanism transmitting power from the drive to the power switching point is routed through the first end face of the pole frame to the active component.

BRIEF DESCRIPTION OF THE DRAWINGS

The disclosure is described in greater detail below, with reference to diagrams. In these diagrams.

DETAILED DESCRIPTION

Figure 1:
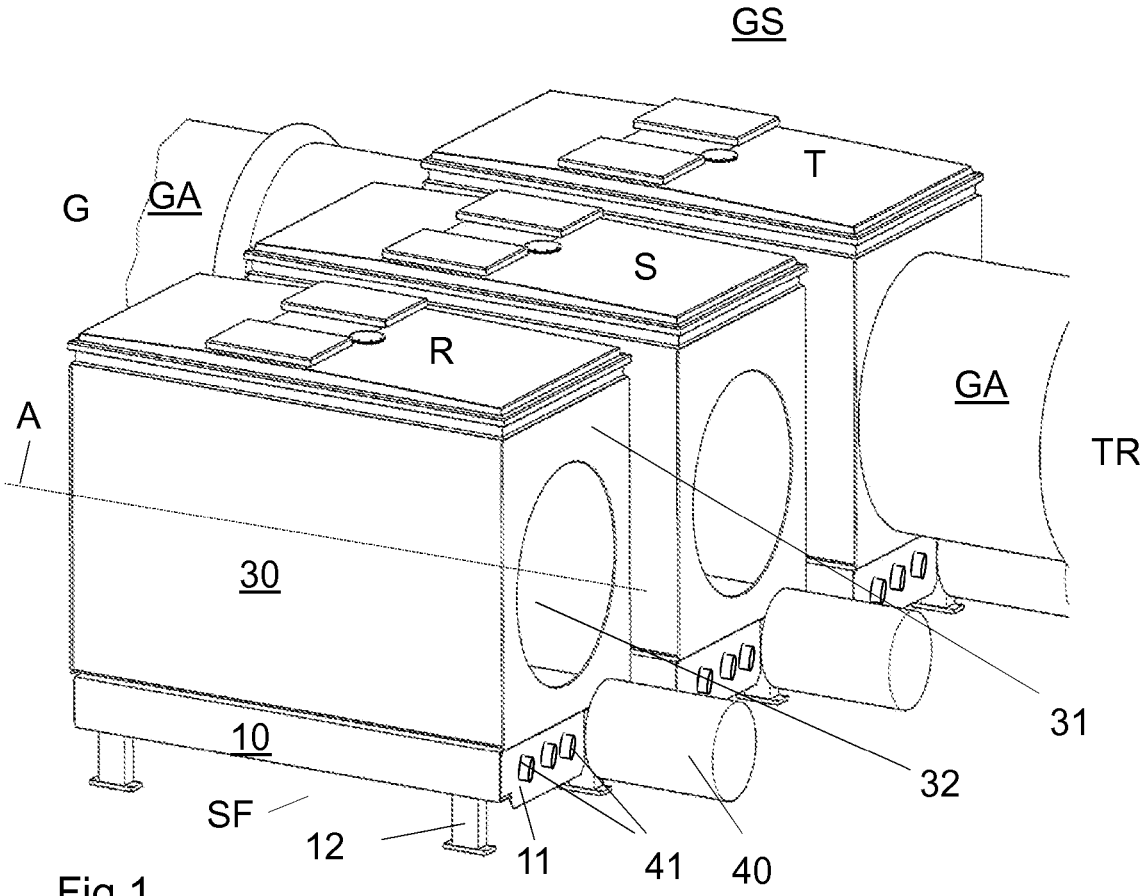
FIG. 1 shows an isometric representation of a three-phase form of the high-current switching arrangement in accordance with an exemplary embodiment of the present disclosure.

Exemplary embodiments of the present disclosure provide a high-current switching arrangement for incorporation in a generator duct, which is characterized by limited spatial conditions, and at the same time is simple to construct and easy to incorporate into said duct.

According to an exemplary embodiment disclosed herein, a high-current switching arrangement is provided for incorporation in a generator duct arranged between a generator and a transformer. This high-current switching arrangement includes a pole frame which can be positioned on a base surface, a breaker pole of a generator circuit-breaker which is secured to the pole frame, and a drive which is secured to the pole frame. The breaker pole is provided with an active component, which is designed for the conduction and interruption of high currents and which incorporates a power switching point, with two axially spaced current terminals for the electrically-conductive integration of the active component upon the incorporation of the high-current switching arrangement in the circuit path of a high-voltage conductor in the generator duct. The drive is arranged on a first of two end faces of the pole frame, oriented transversely to the axis. A linkage mechanism transmitting power from the drive to the power switching point is routed through the first end face of the pole frame to the active component.

As the high-current switching arrangement according to the disclosure then can call for no lateral space in relation to the generator duct or the high-current switching arrangement, the individual breaker poles in a multi-phase high-current switching arrangement can be arranged adjacently to each other in a space-saving design. The breaker poles can then also be configured with a similar construction, in an economically advantageous manner.

In an exemplary embodiment of the high-current switching arrangement, the drive can be arranged below the current terminal. Accordingly, after incorporation of the high-current switching arrangement in the generator duct, the drive is positioned below the conductor of the generator duct. The drive therefore calls for no additional space on the base surface, and is therefore easily accessible e.g. for servicing.

If the high-current switching arrangement includes a box-type enclosure for the accommodation of the active component, with two openings incorporated into the faces of the enclosure, arranged opposite each other and through which the high-voltage conductor of the generator duct can be routed, then the drive is positioned below a first of the two openings in the enclosure and the linkage mechanism is routed to the active component arranged in the interior of the enclosure. As a result of the shock-hazard-protected design of the high-current switching arrangement and the generator duct, it is possible for the drive to be inspected while the generator duct is in service.

In order to facilitate the installation and servicing of the high-current switching arrangement, at least part of the base of the enclosure may be connected to the pole frame in a detachable arrangement, and this part may close a mounting aperture which, after the installation of the high-current switching arrangement and the opening of the mounting aperture, will permit access from the base surface to the interior of the enclosure. Here, integral support legs in the pole frame can facilitate access to the mounting aperture, as these legs increase the clearance between the base surface and the mounting aperture. At the same time, the increased clearance facilitates the intake of fresh air, which may be used for cooling purposes in respect of the active component which is heated up while the high-current switching arrangement is in service. The cooling effect of the fresh air fed between the base surface and the base of the enclosure can be enhanced where the base of the enclosure is perforated in a grid pattern. By this arrangement, the fresh air can penetrate the enclosure from below and absorb heat in the interior of the enclosure. Warmed air can then be evacuated from the enclosure, via openings arranged in the top cover thereof, by the action of thermal convection.

A damage-protected, but nevertheless easily-accessible arrangement for the transmission of power from the drive to the power switching point can be achieved if the linkage mechanism is provided with a twin-arm reversing lever which is arranged to pivot on a fixed point of rotation, together with two push rods, wherein a first end of the first of which is coupled to a first arm of the reversing lever and a second end of which is coupled to a lever which is connected to an insulating shaft which is routed to the power switching point from below in a rigid arrangement, and wherein a first end of the second of which is coupled to the second arm of the reversing lever and a second end of which is coupled to a drive element of the linkage mechanism which is routed in an axially displaceable manner through the pole frame.

On the grounds that, once the high-current switching arrangement is incorporated in the generator duct, the two end faces of the pole frame lie below the shock-hazard-protected generator duct virtually in their entirety, no additional base surface or additional space for installation and maintenance works will be called for if, on the first end face of the pole frame, at least one further drive is arranged with a non-positive connection to a switching device arranged in the enclosure, configured as a disconnector, grounding switch or starting switch for the high-current switching arrangement.

In specific locations for the high-current switching arrangement, it may be advantageous if, on a second end face of the pole frame, arranged opposite the first end face, the former is provided with at least one further drive.

In a multi-phase configuration of the high-current switching arrangement, in consideration of a manufacturing process based upon the configuration of the breaker poles with a similar construction and a corresponding ease of installation, an arrangement where the pole frame carries merely a single (phase-segregated) breaker pole is often the most cost-effective arrangement.

Depending upon the conditions to which the high-current switching arrangement is subject, it may be advantageous for the pole frame to carry at least two breaker poles. In this case, a single drive may be arranged on one of the two end faces of the pole frame, which drive transmits power to the breaker poles via a single linkage mechanism.

FIG. 1 shows an isometric representation of a three-phase form of the high-current switching arrangement in accordance with an exemplary embodiment of the present disclosure. The three-phase high-current switching arrangement represented in FIG. 1, specifically represented as a generator circuit-breaker arrangement, is configured with a phase-segregated arrangement, and includes three enclosed breaker poles R, S, T of substantially identical design in a generator circuit-breaker GS. This arrangement may be incorporated in a shock-hazard-protected generator duct GA, which runs from a generator G to a high-voltage transformer TR. In FIG. 1, the shock-hazard protection means duct of the generator duct GA, which can be configured as a metal duct and surrounds a phase conductor which is centrally routed in that duct, is only shown for phase T.

As the three breaker poles of the generator circuit-breaker are of virtually identical design, only one of the breaker poles, in this case breaker pole R, is described in greater detail here. This breaker pole is securely mounted to a quadrilateral metal pole frame 10, which is isolated from the remaining breaker poles S and T.

Figure 2:
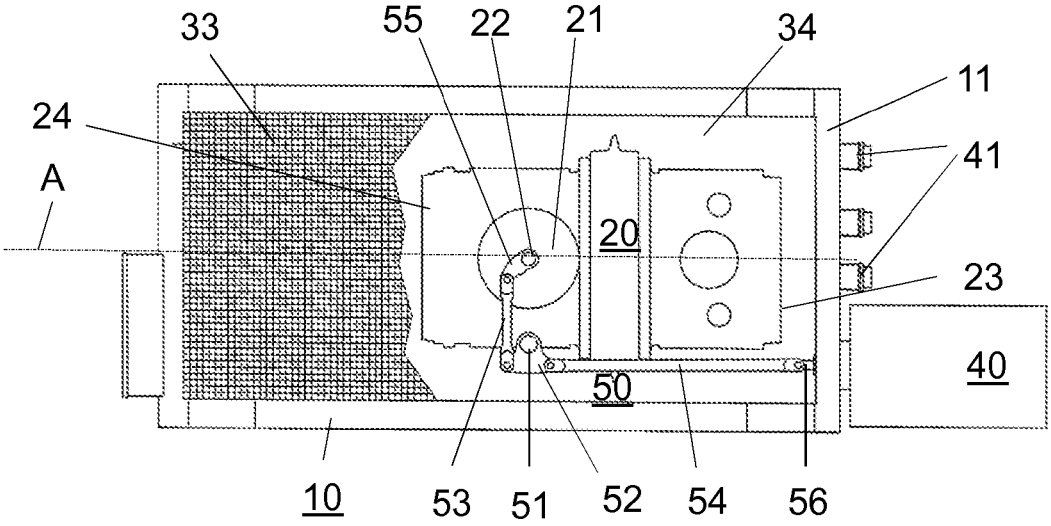
FIG. 2 shows a perspective view from below of a breaker pole assigned to phase R in the high-current switching arrangement represented in FIG. 1, in accordance with an exemplary embodiment of the present disclosure.

FIG. 2 shows a perspective view from below of a breaker pole assigned to phase R in the high-current switching arrangement represented in FIG. 1, in accordance with an exemplary embodiment of the present disclosure. As can be seen from FIG. 2, the breaker pole is provided with an active component 20 extending along an axis A and which, by means of a post insulator 21 which can be seen in FIG. 2, is secured to a cross-member which is incorporated in the pole frame 10, and which active component is designed for the conduction and interruption of high currents. Once the high-current switching arrangement has been incorporated in the generator duct GA, this active component forms a section of the conductor in the generator duct GA suitable for the conduction of high currents. To this end, this active component is provided with a mechanically-actuatable power switching point—not shown—which is capable of opening or closing a circuit comprising the generator G and the transformer TR, together with two current terminals 23, 24, which can be seen in FIG. 2. These two current terminals are axially spaced, and are designed for the electrically-conductive integration of the active component 20 upon the incorporation of the high-current switching arrangement in the circuit path of the high-voltage conductor in the generator duct GA.

The active component is arranged in a box-type enclosure 30, which can be made of sheet metal, and ensures the shock-hazard protection of the high-current switching arrangement. This enclosure can be secured to the pole frame 10 and is provided with two openings. These openings are integrally formed in faces of the enclosure 30 which are arranged opposite each other, and are oriented substantially perpendicular to the axis A. A first 32 of the two openings is integrally formed in the front-facing face 31. This opening accommodates a section of phase R (not represented) in the generator duct which can be connected to the transformer TR. The other of the two openings (not shown) accommodates a section of the unrepresented phase of the high-voltage conductor in the generator duct GA which can be connected to the generator G.

Upon the incorporation of the high-current switching arrangement in the generator duct GA, the active components 20 of the breaker poles R, S and T which are supported on the pole frame 10 are connected phase-by-phase to the sections of the conductor in the generator duct GA which are routed into the enclosure 30. Shock-hazard protection is provided by the two sections of the metal duct, represented in FIG. 1 for phase T only, and the enclosure 30, which is electrically conductively bonded to the two sections of the duct for instance by welding and which, in common with the two sections of the duct, is can be air-filled.

For the actuation of the switching point, a mechanical drive 40 is provided, which is arranged below the opening 32 on an end face 11 of the pole frame 10 facing the transformer TR. This drive is connected to a linkage mechanism 50, which is shown in FIG. 2, and is routed through the end face 11 of the pole frame 10 to the active component 20 and, accordingly, to the power switching point. The linkage mechanism is provided with a twin-arm reversing lever 52 which is arranged to pivot on a fixed point of rotation 51, together with two push rods 53 and 54. One end of the push rod 53 is coupled to one arm of the reversing lever 52, and the other end is coupled to a lever 55, which is connected to an insulating shaft 22 which is routed into the active component 20 from below in a rigid arrangement and which controls the power switching point of the active component. One of the two ends of the push rod 54 is coupled to the other arm of the reversing lever 52, and its second end is coupled to a drive element 56 of the linkage mechanism 50, which is routed in a displaceable manner, parallel to axis A, through the end face 11 of the pole frame 10.

FIG. 2, shows that the interior of the closure 30 is closed by cover plates, that can be of metal construction, which are perforated in a grid pattern and which form the base 33 of the enclosure 30. The cover plates are connected to the underside of the pole frame 10 in a detachable arrangement, and ensure shock-hazard protection on the underside of the breaker pole R.

When the high-current switching arrangement is in service, a section of the conductor in the generator duct GA which incorporates the active component 20 and is arranged in the enclosure 30 will be subject to heat-up. The grid pattern perforation ensures that cool air can penetrate the interior of the enclosure 30 from below, e.g., between a base surface SF and the base of the enclosure 33, and cool the conductor. As the perforated cover plates are connected to the pole frame 10 in a detachable arrangement, they also close a mounting aperture 34. After the installation of the high-current switching arrangement on the base surface SF and the removal of some of the cover plates or part of the base of the enclosure 33, the mounting aperture will permit access from the base surface SF to the interior of the enclosure 30. Integral support legs 12 in the pole frame 10 facilitate access to the mounting aperture 34, shown in FIG. 1.

As the drive 40 is positioned below the opening 32 and, accordingly, also below the shock-hazard-protected generator duct GA, the drive calls for no additional space on the base surface SF and, as a result of the shock-hazard-protected configuration of the high-current switching arrangement and the generator duct GA, the generator duct can be inspected while the generator duct is in service. As no lateral space is then specified in relation to the generator duct or the high-current switching arrangement, the individual breaker poles R, S, T can be arranged close together. The individual breaker poles can also then be configured with an identical construction, in an economically advantageous manner.

FIGS. 1 and 2 show that three further drives 41 are arranged on the end face 11 of the pole frame 10. Each of these drives 41 is arranged with a non-positive connection by means of a linkage mechanism—not represented—to a switching device arranged in the enclosure, configured as a disconnector, grounding switch or starting switch for the high-current switching arrangement, positioned next to the active component 20 which accommodates the power switching point in the enclosure 30 of the breaker pole R. As these drives are also positioned below the shock-hazard-protected generator duct GA while the high-current switching arrangement is in service, said drives will also calls for no additional base surface S, and may be inspected and, where applicable, also serviced while the high-current switching arrangement is in service.

Depending upon the accessibility of the high-current switching arrangement, the drive 40 or drives 40 and 41 may also be arranged on the end face of the pole frame 10 which faces the generator G.

If the high-current switching arrangement, in addition to the drive 40, is also provided with at least one of the drives 41, the drive 40 may be arranged on one of the two end faces of the pole frame 10, and the at least one drive 41 may be arranged on the other end face (opposite this end face).

In a multi-phase configuration of the high-current switching arrangement, an arrangement where the pole frame 10 carries merely a single (phase-segregated) breaker pole R, S or T can be the most cost-effective arrangement. The breaker poles and the drives associated with each of the breaker poles and linkage mechanisms can then be configured with a structurally equivalent design, in a cost-effective manner, thereby facilitating installation and servicing.

Depending upon the conditions to which the high-current switching arrangement is subject, it may optionally be advantageous for the pole frame 10 to carry at least two breaker poles R, S, T. In such a form of embodiment of the high-current switching arrangement, a single drive may be provided on one of the two end faces, e.g. 11, of the pole frame 10, which drive transmits power to the at least two breaker poles via a single linkage mechanism.

For specific applications, the high-current switching arrangement may also be configured with no shock-hazard protection. Even in this form of embodiment of the high-current switching arrangement according to the disclosure, no additional base surface will be specified for the drive after incorporation in the generator duct as, in this arrangement, the drive will then also be positioned directly below the generator duct.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCES

A Axis
G Generator
GA Generator duct
GS Generator circuit-breaker
R, S, T Current phases, breaker poles associated with the current phases
SF Base surface
TR Transformer
10 Pole frame
11 End face
12 Support legs

20 Active component
21 Post insulator
22 Insulating shaft
23, 24 Current terminals
30 Enclosure
31 Face of enclosure
32 Enclosure opening
33 Base of enclosure
34 Mounting aperture
40 Drive
41 further Drive
50 Linkage mechanism
51 Point of rotation
52 Twin-arm reversing lever
53, 54 Push rods
55 Lever
56 Drive element

What is claimed is:

1. A high-current switching arrangement for incorporation in a generator duct arranged between a generator and a transformer, the arrangement comprising:

a pole frame which can be positioned on a base surface;

a breaker pole of a generator circuit-breaker which is secured to the pole frame; and a drive which is secured to the pole frame, wherein the breaker pole is provided with an active component arranged along an axis designed for conduction and interruption of high currents and which incorporates a power switching point, the breaker pole having two axially spaced current terminals for an electrically-conductive integration of the active component upon incorporation of the high-current switching arrangement in a circuit path of a high-voltage conductor in the generator duct, and wherein the drive is arranged on a first of two end faces of the pole frame and is oriented transversely to the axis, and a linkage mechanism transmitting power from the drive to the power switching point is routed through the first end face of the pole frame to the active component, comprising a box-type enclosure that accommodates the active component, the enclosure having two openings incorporated into faces of the enclosure, the two openings are arranged opposite each other and allow the high-voltage conductor of the generator duct to be routed there through, wherein the drive is positioned below a first of the two openings in the enclosure, and the linkage mechanism is routed to the active component arranged in an interior of the enclosure, and wherein at least part of a base of the enclosure is detachably connected to the pole frame and closes a mounting aperture which, after installation of the high-current switching arrangement and an opening of the mounting aperture, will permit access from a surface of the base to the interior of the enclosure.

2. The high-current switching arrangement as claimed in claim 1, wherein the drive is arranged below a first of the two current terminals of the active component.

3. The high-current switching arrangement as claimed in claim 1, wherein the pole frame includes support legs.

4. The high-current switching arrangement as claimed in claim 1, wherein the base of the enclosure is perforated in a grid pattern.

5. The high-current switching arrangement as claimed in claim 1, wherein, on the first end face of the pole frame, at least one additional drive is arranged with a non-positive connection to a switching device arranged in the enclosure, the switching device being configured as a disconnector, grounding switch, or starting switch for the high-current switching arrangement.

6. The high-current switching arrangement as claimed in claim 5, comprising:

at least two phase-segregated breaker poles including at least two pole frames, each of which carries one of the breaker poles and one drive.

7. The high-current switching arrangement as claimed in claim 5, comprising:

at least two phase-segregated breaker poles, wherein in the pole frame carries the at least two breaker poles.

8. The high-current switching arrangement as claimed in claim 7, wherein the drive transmits power to the at least two breaker poles via a single linkage mechanism.

9. The high-current switching arrangement as claimed in claim 1, wherein, on a second end face of the pole frame, opposite the first end face, at least one additional drive is arranged with a non-positive connection to a switching device arranged in the enclosure, the switching device being configured as a disconnector, grounding switch, or starting switch for the high-current switching arrangement.

10. The high-current switching arrangement as claimed in claim 9, wherein the at least one additional drive is positioned below the generator duct, which has shock-hazard-protection, while the high-current switching arrangement is in service.

11. A high-current switching arrangement for incorporation in a generator duct arranged between a generator and a transformer, the arrangement comprising:

a pole frame which can be positioned on a base surface;

a breaker pole of a generator circuit-breaker which is secured to the pole frame; and a drive which is secured to the pole frame, wherein the breaker pole is provided with an active component arranged along an axis designed for conduction and interruption of high currents and which incorporates a power switching point, the breaker pole having two axially spaced current terminals for an electrically-conductive integration of the active component upon incorporation of the high-current switching arrangement in a circuit path of a high-voltage conductor in the generator duct, and wherein the drive is arranged on a first of two end faces of the pole frame and is oriented transversely to the axis, and a linkage mechanism transmitting power from the drive to the power switching point is routed through the first end face of the pole frame to the active component, wherein the linkage mechanism includes a twin-arm reversing lever which is arranged to pivot on a fixed point of rotation, together with two push rods, wherein a first end of the first push rod is coupled to a first arm of the reversing lever and a second end of the first push rod is coupled to a lever connected to an insulating shaft that is routed to the power switching point from below in a rigid arrangement, and wherein a first end of the second push rod is coupled to a second arm of the reversing lever and a second end of the second push rod is coupled to a drive element of the linkage mechanism that is routed in an axially displaceable manner through the pole frame.

* * * * *